US007201025B2

(12) United States Patent
Mahre et al.

(10) Patent No.: US 7,201,025 B2
(45) Date of Patent: Apr. 10, 2007

(54) SECURING MECHANISM FOR GOLF CLUBS

(76) Inventors: Roger O. Mahre, 1655 Berkeley Ave., St. Paul, MN (US) 55105; Charles R. Halverson, 4821 Chicago Ave. S., Minneapolis, MN (US) 56417

( * ) Notice: Subject to any disclaimer, the term of this patent is extended or adjusted under 35 U.S.C. 154(b) by 0 days.

(21) Appl. No.: 10/253,079

(22) Filed: Sep. 24, 2002

(65) Prior Publication Data

US 2004/0055343 A1 Mar. 25, 2004

(51) Int. Cl.
*E05B 73/00* (2006.01)
*A63B 55/00* (2006.01)

(52) U.S. Cl. ..... 70/18; 70/19; 70/58; 70/62; 24/481; 206/315.2; 211/70.2; 224/315

(58) Field of Classification Search .. 206/315.2–315.8; 211/70.2, 7; 24/481; 70/58, 62, 14, 15–19, 70/61; 224/315, 246, 250, 463, 535, 324, 224/569, 572; 248/499, 505, 551–553
See application file for complete search history.

(56) References Cited

U.S. PATENT DOCUMENTS

| | | | | | |
|---|---|---|---|---|---|
| 532,242 | A | * | 1/1895 | McShane | 24/481 |
| 539,650 | A | * | 5/1895 | Searle | 70/16 |
| 548,318 | A | * | 10/1895 | Koch | 70/65 |
| 1,475,256 | A | * | 11/1923 | Belair | 70/18 |
| 1,502,031 | A | * | 7/1924 | Gray | 24/481 |
| 2,469,592 | A | * | 5/1949 | Byer | 70/174 |
| 3,838,585 | A | * | 10/1974 | Foote | 70/18 |
| 4,249,716 | A | * | 2/1981 | Barron | 251/146 |
| 4,342,477 | A | * | 8/1982 | McClure | 292/307 R |
| 4,538,728 | A | | 9/1985 | Lewis | 206/315.3 |
| 4,741,051 | A | * | 5/1988 | Bible | 2/158 |
| 4,831,849 | A | | 5/1989 | Kortenbrede | 70/49 |
| 4,854,138 | A | * | 8/1989 | Charland | 70/16 |
| 4,863,019 | A | | 9/1989 | Lewis et al. | 206/315.3 |
| 4,909,051 | A | * | 3/1990 | Lee | 70/16 |
| 5,004,100 | A | | 4/1991 | Smith | 206/315.2 |
| 5,267,660 | A | | 12/1993 | Kwon | 211/702.2 |
| 5,398,383 | A | * | 3/1995 | Bingold | 24/16 PB |
| 5,443,155 | A | * | 8/1995 | Robinson | 206/223 |
| 5,473,917 | A | * | 12/1995 | Say | 70/49 |
| 5,517,835 | A | * | 5/1996 | Smith | 70/14 |
| 5,524,753 | A | | 6/1996 | Murphy | 206/315.6 |
| 5,531,083 | A | | 7/1996 | Franck, III et al. | 70/58 |
| 5,581,853 | A | * | 12/1996 | Miller et al. | 24/302 |
| 5,582,043 | A | | 12/1996 | McCue et al. | 70/58 |
| 5,590,772 | A | | 1/1997 | Schuhlen et al. | 206/315.3 |
| 5,636,735 | A | | 6/1997 | Stusek | 206/315.6 |
| 5,802,889 | A | * | 9/1998 | Arnold | 70/18 |
| 5,862,909 | A | | 1/1999 | Jacobsen | 206/315.3 |

(Continued)

*Primary Examiner*—Lloyd A. Gall
(74) *Attorney, Agent, or Firm*—Schwegman, Lundberg, Woessner & Kluth P.A.

(57) ABSTRACT

A golf club securing mechanism includes a rigid member and a flexible member. The flexible member is wovenly engaged with the rigid member to define one or more golf club holding regions between the flexible member and the rigid member. The flexible member can be manipulated to vary a size of the one or more golf club holding regions such that in a loose position a golf club can be positioned within one of the golf club holding regions and in a tightened position the golf club is tightly fixed between the rigid member and the flexible member.

14 Claims, 7 Drawing Sheets

U.S. PATENT DOCUMENTS

| | | | | | |
|---|---|---|---|---|---|
| 5,918,490 | A | | 7/1999 | Lion | 70/58 |
| 5,971,146 | A | | 10/1999 | Jones | 206/315.3 |
| 6,003,348 | A | * | 12/1999 | McCrea | 70/18 |
| 6,006,904 | A | | 12/1999 | Jacobsen | 206/315.6 |
| 6,050,405 | A | | 4/2000 | Rossi et al. | 206/315.2 |
| 6,062,050 | A | | 5/2000 | Lion | 70/58 |
| 6,079,558 | A | | 6/2000 | Yoon | 206/315.3 |
| 6,102,202 | A | | 8/2000 | Jones | 206/315.6 |
| 6,142,319 | A | | 11/2000 | Kim | 211/70.2 |
| 6,196,385 | B1 | | 3/2001 | Thompson et al. | 206/315.6 |
| 6,205,823 | B1 | | 3/2001 | Volk, Sr. | 70/58 |
| 6,381,998 | B1 | | 5/2002 | Good | 70/58 |
| 2001/0017272 | A1 | | 8/2001 | Thompson et al. | 206/315.6 |

* cited by examiner

SECURING MECHANISM FOR GOLF CLUBS

FIELD OF INVENTION

This invention relates to golf supplies, and more particularly to a golf club security device.

BACKGROUND

As the popularity of golf continues to rise, and as the proliferation of specialty clubs increases, so has golf club theft. It is not uncommon for the average golfer to have in excess of $2,000.00 of clubs in his or her bag. After completing a round of golf, it is common for a golfer to leave the bag unsecured and unattended for long periods of time. This exposes the individual clubs or entire bag with all its contents to easy theft.

Various devices have been designed and implemented to secure clubs to one another, or integrated bag locks that secure the clubs within the bag. No such device is easily portable from bag to bag, or offers security of a variety of bag configurations and club quantities. Nor typically does the locking device provide a means to secure clubs or bag to a permanent rack, or other object.

One such device is disclosed in U.S. Pat. No. 5,004,100, which discusses a device having a plate designed to fit over the open end of a golf bag. The plate has three slots which are closed at one end and open at the other so that a group of clubs can be laterally inserted therein. A U-shaped arm is pivotally attached to the flat plate to close the open end of the slots. The arm can then be locked in place to prevent removal of the clubs.

Such devices are relatively heavy and thereby tend to discourage golfers who prefer to carry their own bag as they play and wish to keep the bag as light as possible. Also, such devices are non-adjustable as to the distance between the slots. Golf bags are sold in a variety of sizes and configurations. A rigid system of locking the clubs restricts the golfer to bags that fit the limitations of the lock. It is likely that a golfer will purchase two or three different bags over the life of his or her clubs and therefore be forced to purchase a new lock with each as the configurations or size change. Further, with the relatively high cost of the device, this makes it impractical.

SUMMARY

A golf club securing mechanism including a rigid member and a flexible member. The flexible member is wovenly engaged with the rigid member to define one or more golf club holding regions between the flexible member and the rigid member. The flexible member can be manipulated to vary a size of the one or more golf club holding regions such that in a loose position a golf club can be positioned within one of the golf club holding regions and in a tightened position the golf club is tightly fixed between the rigid member and the flexible member. In one example, the second end of the flexible member can be used to secure the securing mechanism to an available fixed object, such as a tree. One example includes a retaining mechanism to secure the flexible member to the rigid member to prevent the flexible member from being pulled after the flexible member has been tightened. One example provides one or more protruding sections located on the rigid member for holding the flexible member when the flexible member is tightened relative to the rigid member. In use, the club securing mechanism is set over the heads of a plurality of clubs in the bag, and the flexible member cinches the narrow base of the clubs against the rigid member.

Among other advantages, the present device is lightweight and portable and suitable for use with a wide variety of golf bag sizes and configurations. Further, this device is simple to use, and easy and inexpensive to construct. This device allows the clubs to be secured within the bag and secure any number of clubs, from one to 20 or more. The device allows the user, at their discretion to secure the bag and its contents to a rack, tree, stand or similar permanent structure to prevent the theft of the entire bag including its contents. This device can be independent from the bag, compact, flexible and lightweight. Its size and construction also allows easy storage within the bag during the round of golf without significantly impacting the weight or internal storage of the bag.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
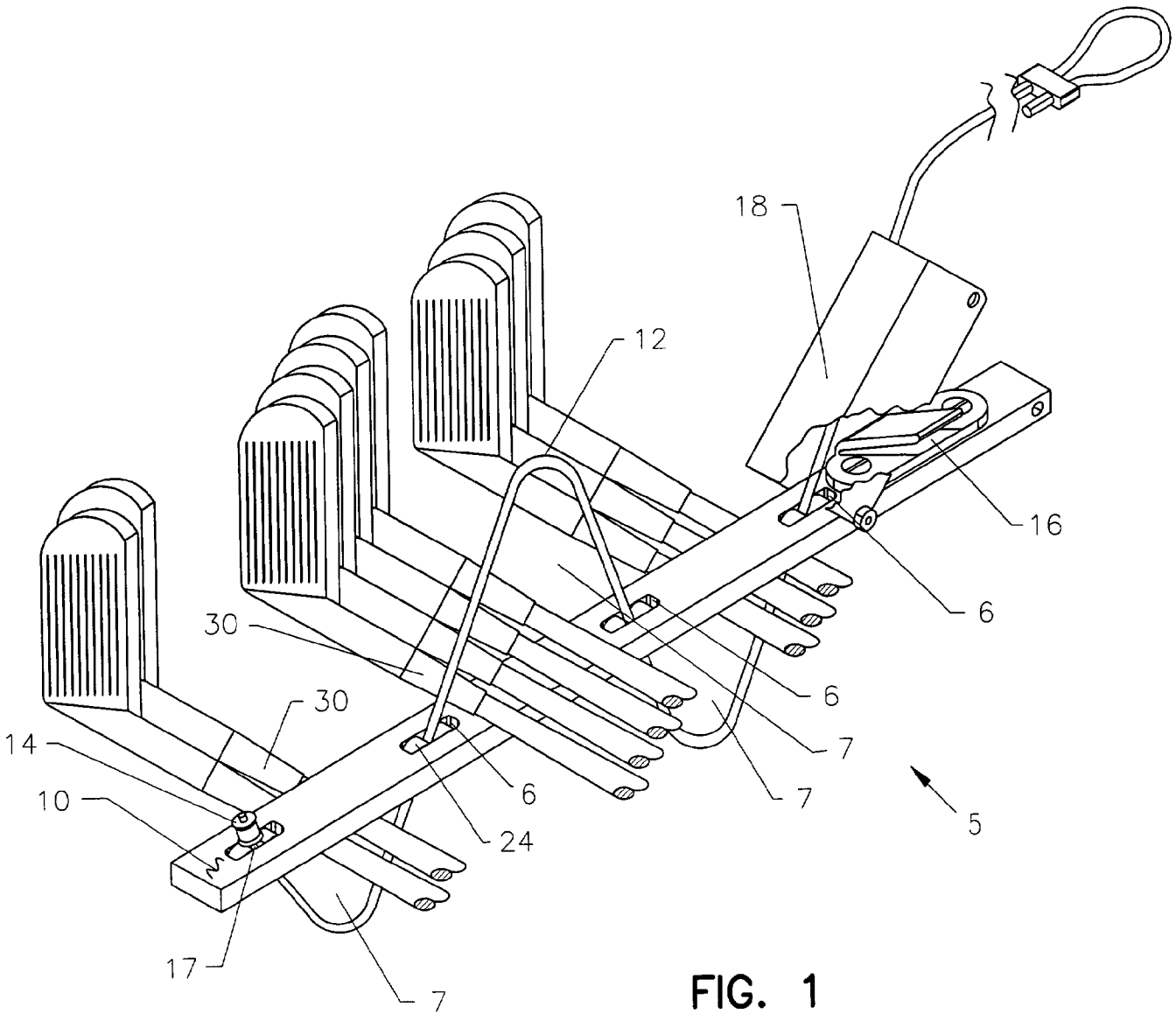
FIG. 1 shows an isometric view of a golf club securing mechanism according to one embodiment.
Figure 2:
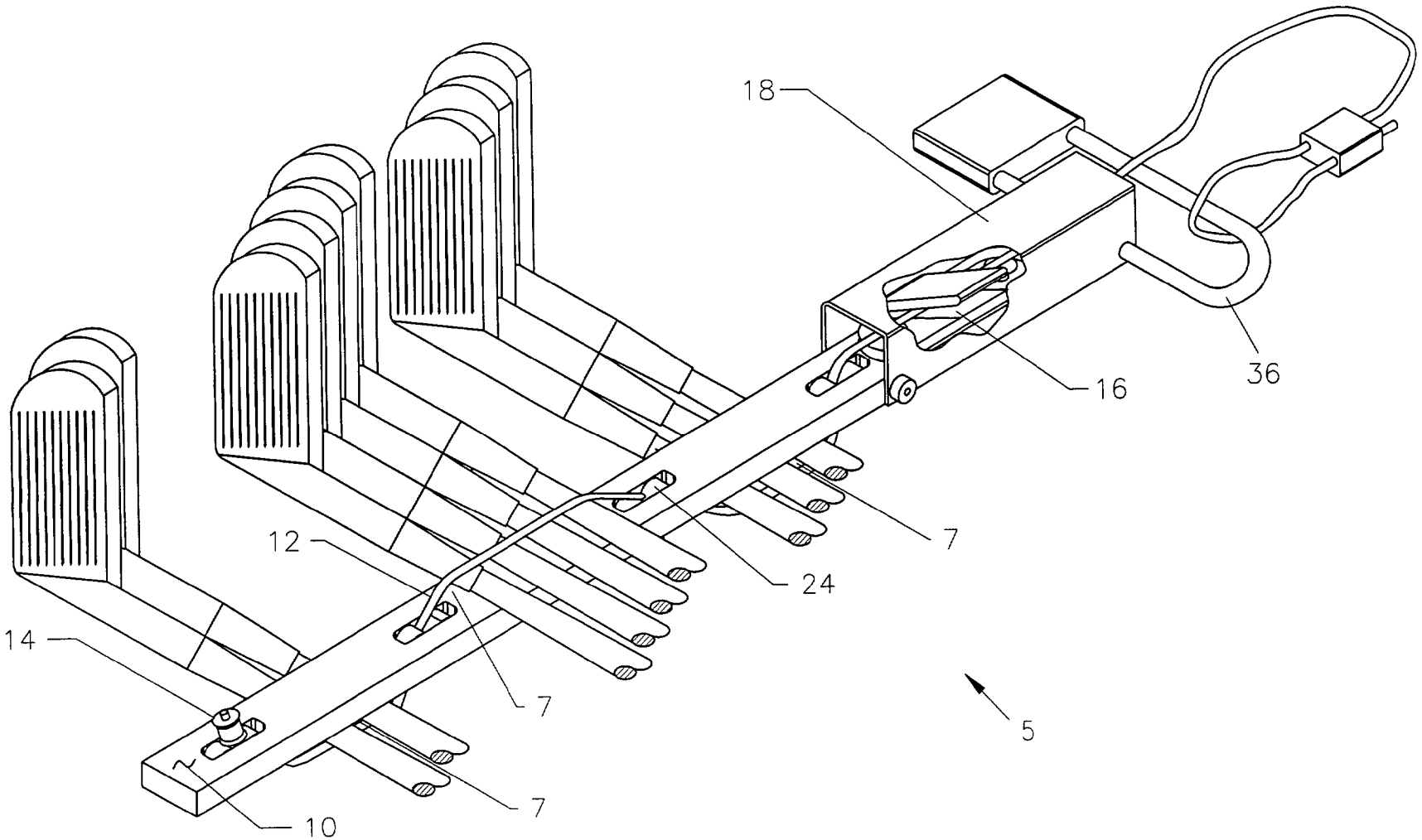
FIG. 2 show the golf club securing mechanism of FIG. 1 in a locked position.

FIGS. 1–2 shows an isometric view of a golf club securing mechanism 5 according to one embodiment. Golf club securing mechanism 5 includes a rigid member 10 and a flexible member 12 wovenly engaged with the rigid member. Rigid member 10 includes an elongated rigid bar which serves as the structural member to which other components of this device attach. Rigid member 10 can be a rigid aluminum bar approximately 16 inches long. Other example rigid members can be made of other metals, molded plastic, wood, hardened rubber, or a composite material. One embodiment includes padding, such as rubber, along at least a portion of the rigid member so that the golf clubs rub against the padding when they are mounted within the golf club mounting region.

The rigid member can have a length varying form 12 inches to approximately 24 inches, or longer. Rigid member 10 includes a plurality of holes 6 arranged along its long axis through which flexible member 12, such as a flexible cable or cord, passes in an intertwining manner. In this example, holes 6 are spaced to provide three club-holding regions 7 between rigid member 10 and flexible member 12 where golf clubs 30 may be secured by cinching flexible member 12 around the small diameter section of the golf club shaft adjacent to the club head. The number of club-holding regions can be varied from 1, 2, 3, 4, or more.

In this example, flexible member 12 is a vinyl coated stranded galvanized steel cord. By way of example, other embodiments provide a flexible member 12 made of a stainless steel cord, a bronze cord, an aluminum cord, a stranded rope, a chain, round belting, etc. The flexible member can vary in length from 3 feet long to 10 feet long.

Holes 6 are positioned along the length of rigid member 10 to provide flexibility with respect to the golf bags this device may be used with. Varying lengths of the flexible member 12 may be pulled through these holes to allow varying numbers of clubs to be secured in each club-holding region 7, as dictated by bag configuration or number of clubs golfer carries. A first end 17 of flexible member 12 is loosely mounted to a hole in the end of the rigid member 10 by a compression sleeve 14. This arrangement allows end 17 to vary its angle relative to rigid member 10. This allows the first region 7 to be cinched tightly when the device is used. Some examples omit this structure and tightly attach the end 17 directly to rigid member 10.

This example includes anti-friction bearings 24 located within each hole 6 to provide for one hand cinching and also ensuring that flexible member 12 is pulled tightly around club shafts. Some examples omit the bearings 24 and provide countersunk holes or angled holes through rigid member 10.

Securing mechanism 5 includes a retaining mechanism 16, such as a cleat, to secure flexible member 12 after it has been cinched around one or more club shafts. FIG. 2 shows how an intermediate portion of flexible member 12 can be engaged within the space of retaining mechanism 16 to secure the flexible member relative to the rigid member. In other embodiments, retaining mechanism 16 can be a clamp, a cam retainer, a four-bar linkage, or other holding member to tightly hold the cinched flexible cord in place relative to the rigid member.

A swinging cover 18 is provided to restrict access to flexible member 12 when the device is in the locked position (see FIG. 2). The cover is dimensioned so that one side surface of the cover is close to the open end of retaining mechanism 16 so that an unauthorized person cannot jiggle the flexible cord out of the retaining mechanism. As shown in FIG. 2, when cover 18 is shut, a lock 36 can be engaged through holes in the cover and the rigid member to lock the cover to the rigid member.

Figure 7A:
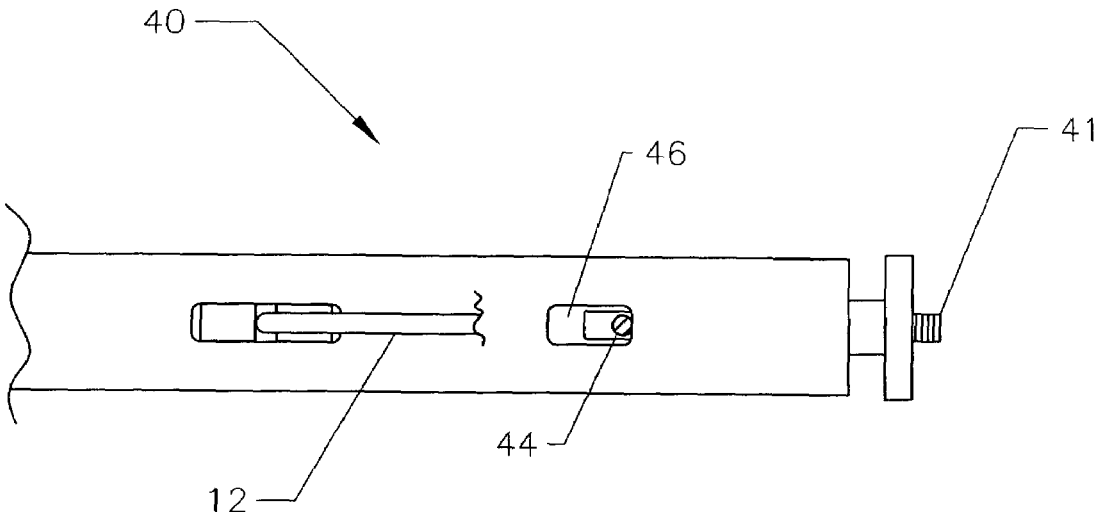
FIGS. 7A and 7B show a top and side view respectively of a retaining mechanism according to one embodiment.
Figure 7B:
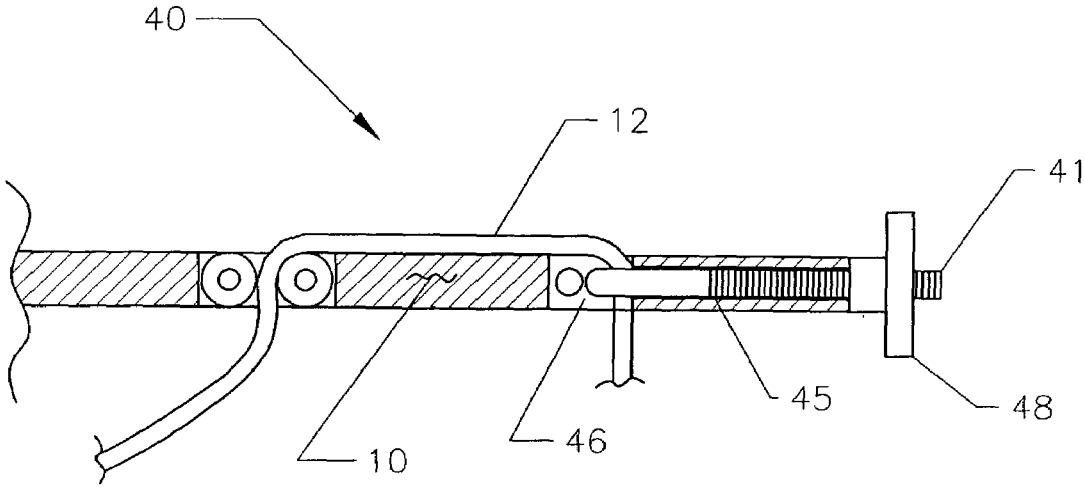

In some embodiments, cover 18 can be omitted and a different retaining mechanism utilized. FIGS. 7A and 7B show a threaded retaining mechanism 40. Mechanism 40 includes a threaded rod 41 that passes through a hole 45 that is aligned with the long axis of rigid member 10. Hole 45 terminates in a cut out 46. A hole 44 is provided in the end of rod 41 for the flexible member 12 to pass through. In use, after the flexible member is tightened around the club shafts, the flexible member is passed through hole 44, and the threaded rod is tightened using a thumb nut 48 to pull the flexible member 12 against the side of cut out 46.

Figure 3:
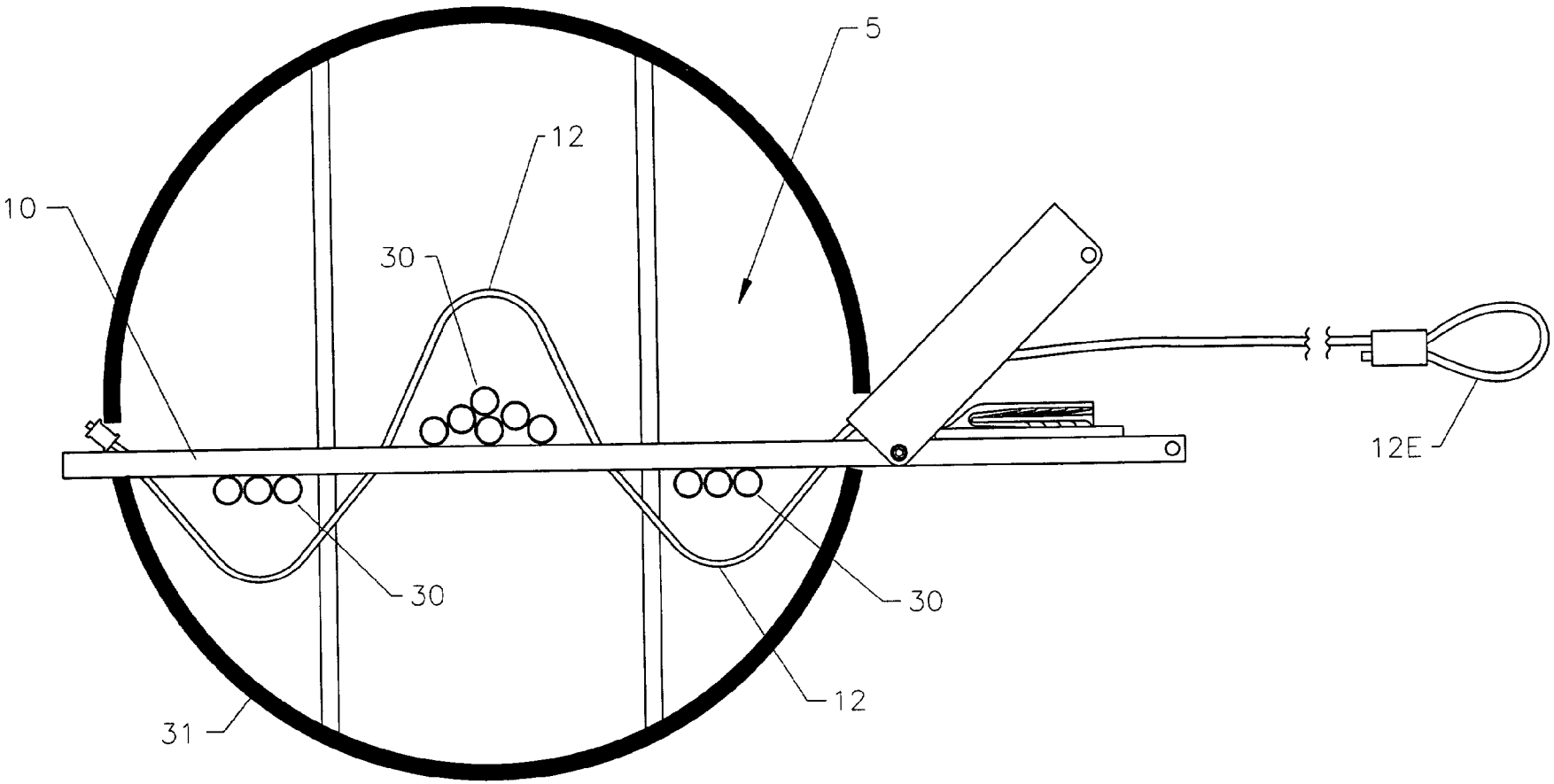
FIGS. 3–5 show a top view of the club securing mechanism of FIG. 1 being used to secure a plurality of golf clubs.
Figure 4:
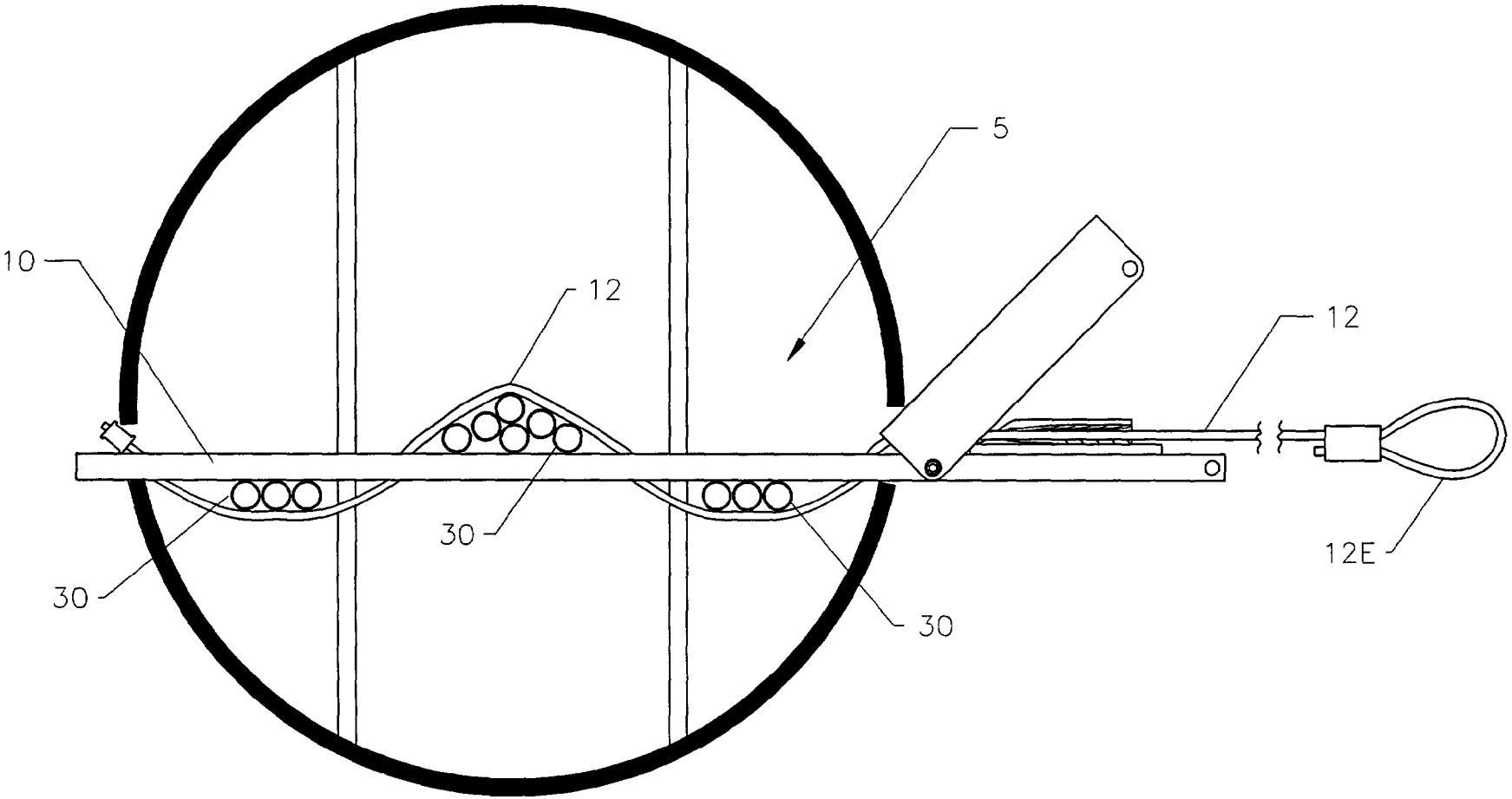
Figure 5:
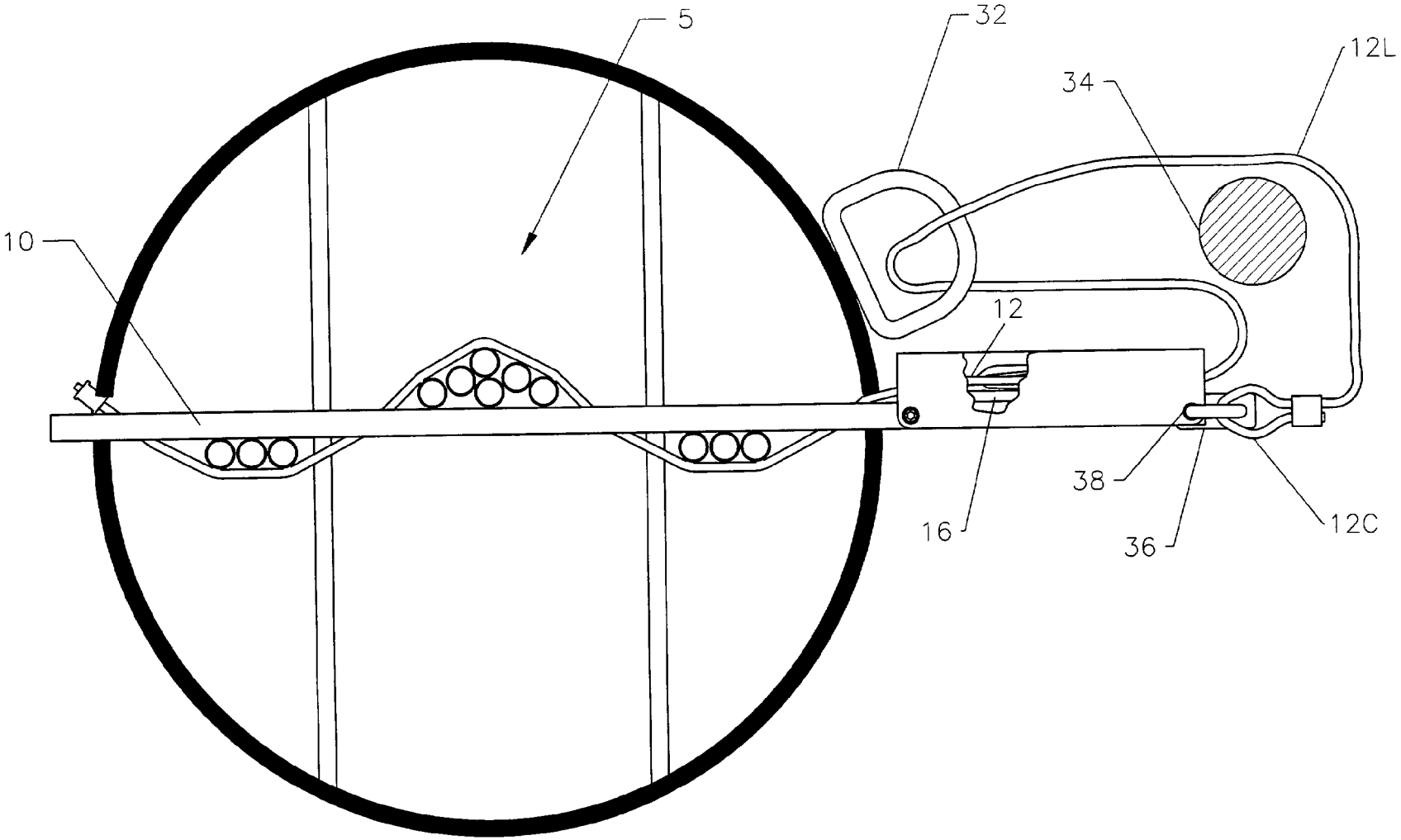

FIGS. 3–5 show a top view of club securing mechanism 5 being used to secure a plurality of golf clubs 30. In use, the present golf club and bag security device is operated by the user arranging the clubs in a golf bag 31 as shown in FIG. 3. Flexible member 12 of securing mechanism 5 is loosened to give the club heads adequate room to place the rigid member 10 between the club shafts and flexible member 12. Flexible member 12 is pulled from a second end 12E to remove the slack in the flexible member thus cinching clubs 30 against rigid member 10 below the club head at or near the narrowest point on the shaft of the club.

Flexible member 12 is secured in retaining mechanism 16 and cover 18 is lowered over retaining mechanism 16. Any excess length of flexible member 12 is threaded through a secure feature 32 of the golf club bag such as a welded ring or permanent carry handle. Finally, the excess length 12L of the flexible member is wrapped around an available fixed object 34 such as a tree or golf bag rack and a lock 36 is placed through the flexible member end loop 12C and through the shackle holes 38 in rigid member 10 and cover 18 and locked.

Removing the golf club and bag security device requires the user to unlock and remove the lock and lift the retaining mechanism cover and remove the flexible member from the retaining mechanism. This allows the flexible member to slacken and be lifted over the now free club heads. The excess flexible member is wrapped around the rigid member making the device easily storable in most golf bags storage compartments when not in use.

By not directly mounting rigid member 10 to the bag, the present securing device can be used for a plurality of different bag configurations (i.e. it is independent of the bag). The single elongated rigid member and flexible member are relatively small and light and thus can be easily carried and stored in a golf bag when not in use.

Figure 6:
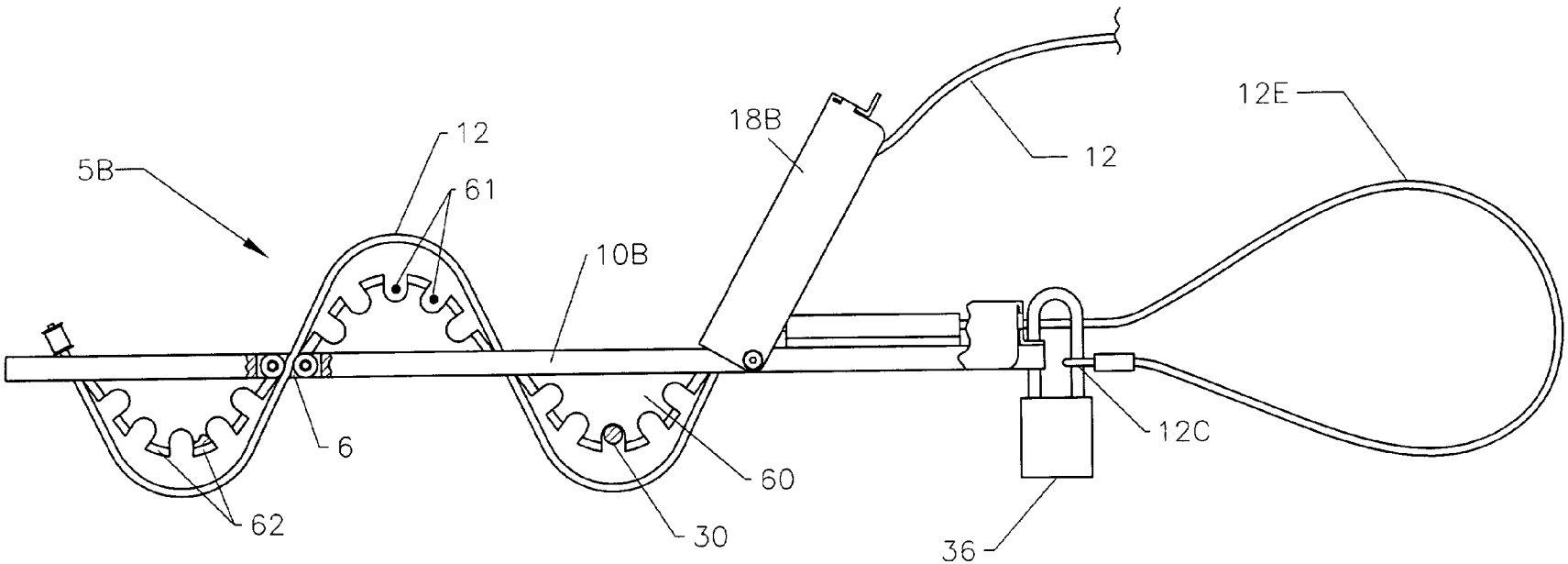
FIG. 6 shows a side view of a golf club securing mechanism according to one embodiment.

FIG. 6 shows a side view of a golf club securing mechanism 5B according to one embodiment. Securing mechanism 5B includes a rigid member 10B and a flexible member 12. In this example, rigid member 10B includes one or more protruding sections such as clamping blocks 60. These protruding sections are on alternating sides of the rigid member and located between holes 6. The protruding members provide to increase the linear clamping distance while keeping the overall length of the rigid bar the same. The protruding section can be a separate section attached to the rigid bar or it can be integral part of the rigid member, for example, a molded design. Clamping blocks 60 lessen the effort needed to cinch the flexible member tight and also prevent any slack from forming in the flexible member if the clubs shift in position within the bag. Clamping blocks include a plurality of cutouts 61 for clubs 30. This example provides a groove 62 around the periphery of each clamping block 60. Flexible member 12 can be positioned within the groove when the flexible member is cinched and the groove prevents access to the cable.

FIG. 6 also shows another embodiment of a cover 18B. Cover 18B includes a flange or lip on the end of the cover. The flange includes a hole which matches a hole in the rigid member and allows the cover to be locked to the rigid member by lock 36.

It is understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A golf club securing mechanism for use with a golf bag holding one or more golf clubs, comprising:

a golf bag;

one or more golf clubs;

a straight, rigid member; and a flexible member having a first end engaged to the rigid member, the flexible member extending through two or more portions of the rigid member to define two or more regions between the rigid member and the flexible member, there being at least one region on each side of the straight, rigid member;

wherein the one or more golf clubs can be inserted within the two or more regions and wherein the flexible member can be tightened relative to the rigid member such that the two or more regions become smaller thus securing the one or more golf clubs within the two or more regions, wherein the rigid member and the flexible member are removable from the golf bag.

2. The golf club securing mechanism of claim 1, wherein a second end of the flexible member can be used to secure the securing mechanism to an available fixed object.

3. The golf club securing mechanism of claim 1, wherein the rigid member includes an elongated bar having a length of approximately 24 inches or less and a width no greater than approximately 2 inches.

4. The golf club securing mechanism of claim 1, wherein the two or more portions of the rigid member include two or more holes spaced along the length of the rigid member.

5. The golf club securing mechanism of claim 4, wherein each of the two or more holes includes bearings within the holes.

6. The golf club securing mechanism of claim 1, including a retaining mechanism, wherein the flexible member, after being tightened, is secured to the rigid member by the retaining mechanism, which is adapted to prevent the flexible member from being pulled out of the retaining mechanism from either one or both directions.

7. The golf club securing mechanism of claim 6, wherein the retaining mechanism is lockable by means of a lock.

8. The golf club securing mechanism of claim 6, wherein the securing mechanism includes a cover closable and lockable over the retaining mechanism to prevent access to the retaining mechanism.

9. The golf club securing mechanism of claim 1, wherein the rigid member includes one or more protruding sections located between the two or more portions.

10. The golf club securing mechanism of claim 9, wherein the one or more protruding sections include curved portions having a groove around the outer edge for holding the flexible member when the flexible member is tightened relative to the rigid member.

11. A golf club securing mechanism, comprising:

an elongate straight, rigid member having three or more holes spaced along a long axis of the rigid member;

a flexible member having a first end attached near a first end of the rigid member and threaded back and forth in turn through the three or more holes of the rigid member to define a plurality of golf club holding regions, each of the golf club holding regions being between the flexible member and the rigid member between each of the holes on alternating sides of the rigid member, the flexible member having a second, free end which can be pulled to tautly position the flexible member proximate the rigid member and decrease the size of each of the golf club holding regions to tightly couple a golf club between the flexible member and the rigid member; and a retaining mechanism located near a second end of the rigid member to hold an intermediate portion of the flexible member tightly in place relative to the rigid member when the flexible member is tightened.

12. The golf club securing mechanism of claim 11, wherein the second end of the flexible member can be used to secure the securing mechanism to an available fixed object.

13. The golf club securing mechanism of claim 11, further including a cover to position over the retaining mechanism to prevent manipulation of the flexible member and the retaining mechanism.

14. The golf club securing mechanism of claim 11 further including, in combination, a golf bag and a plurality of club clubs, wherein the rigid member and the flexible member are removable from the golf bag.

* * * * *